US010187929B1

(12) United States Patent
McFadden

(10) Patent No.: US 10,187,929 B1
(45) Date of Patent: Jan. 22, 2019

(54) PORTABLE FOOD-WARMING DEVICE

(71) Applicant: Sharon McFadden, Venice, FL (US)

(72) Inventor: Sharon McFadden, Venice, FL (US)

( * ) Notice: Subject to any disclaimer, the term of this patent is extended or adjusted under 35 U.S.C. 154(b) by 365 days.

(21) Appl. No.: 15/096,445

(22) Filed: Apr. 12, 2016

(51) Int. Cl.

| | |
|---|---|
| ***H05B 3/06*** | (2006.01) |
| ***H05B 1/02*** | (2006.01) |
| ***A45D 2/00*** | (2006.01) |
| ***A45D 1/04*** | (2006.01) |

(52) U.S. Cl.
CPC ..... *H05B 3/06* (2013.01); *A45D 1/04* (2013.01); *A45D 2/001* (2013.01); *H05B 1/0255* (2013.01); *H05B 1/0261* (2013.01); *A45D 2001/045* (2013.01)

(58) Field of Classification Search
CPC .... A45D 2/001; A45D 1/04; A45D 2001/045; H05B 3/06; H05B 1/0255; H05B 1/0261; H05B 1/00; H05B 3/02; H05B 11/00
USPC ..... 219/225, 227–229, 201; 206/372–374
See application file for complete search history.

(56) References Cited

U.S. PATENT DOCUMENTS

| | | | | |
|---|---|---|---|---|
| 2,920,243 | A * | 1/1960 | Taren | A47J 37/079 126/25 B |
| D287,285 | S | 12/1986 | Futatsugi | |
| 5,345,059 | A * | 9/1994 | Wen | A47J 43/281 219/227 |
| 5,706,390 | A | 1/1998 | O'Neil | |
| 5,968,396 | A | 10/1999 | Rodriguez | |
| 6,234,165 | B1 | 5/2001 | Creighton | |
| 6,703,590 | B1 | 3/2004 | Holley, Jr. | |
| 8,591,214 | B2 * | 11/2013 | Moore | A23G 9/28 425/276 |
| 2003/0234205 | A1 * | 12/2003 | McGuyer | A47J 43/28 206/564 |
| 2015/0292691 | A1 * | 10/2015 | Li | F21L 4/085 362/158 |

FOREIGN PATENT DOCUMENTS

WO WO2010068112 A1 6/2010

* cited by examiner

*Primary Examiner* — Michael G Hoang

(57) ABSTRACT

The portable food-warming device is a kit comprising a plurality of kitchen equipment items that is designed to heat food and are designed to be portable. The plurality of kitchen equipment items contains a built in heating element and is designed to fit interchangeably with a handle. The handle contains a battery that is used to power each of the plurality of kitchen equipment items. The portable food-warming device comprises a plurality of kitchen equipment items and a handle.

2 Claims, 5 Drawing Sheets

PORTABLE FOOD-WARMING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of domestic articles and appliances, more specifically, kitchen equipment items designed to warm food and or hair-heating tools, and which are collectively interchangeable.

SUMMARY OF INVENTION

The portable food-warming device is a kit comprising a plurality of kitchen equipment items that is designed to heat food and are designed to be portable. The plurality of kitchen equipment items contains a built in heating element and is designed to fit interchangeably with a handle. The handle contains a battery that is used to power each of the plurality of kitchen equipment items. The plurality of kitchen equipment items may be more broadly referred to as a plurality of equipment items, which are able to provide alternative uses aside of preparing and serving food.

These together with additional objects, features and advantages of the portable food-warming device will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable food-warming device in detail, it is to be understood that the portable food-warming device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable food-warming device.

It is therefore important that the claims be regarded as including such equivalent construction insofar as they do not depart from the spirit and scope of the portable food-warming device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

Figure 1:
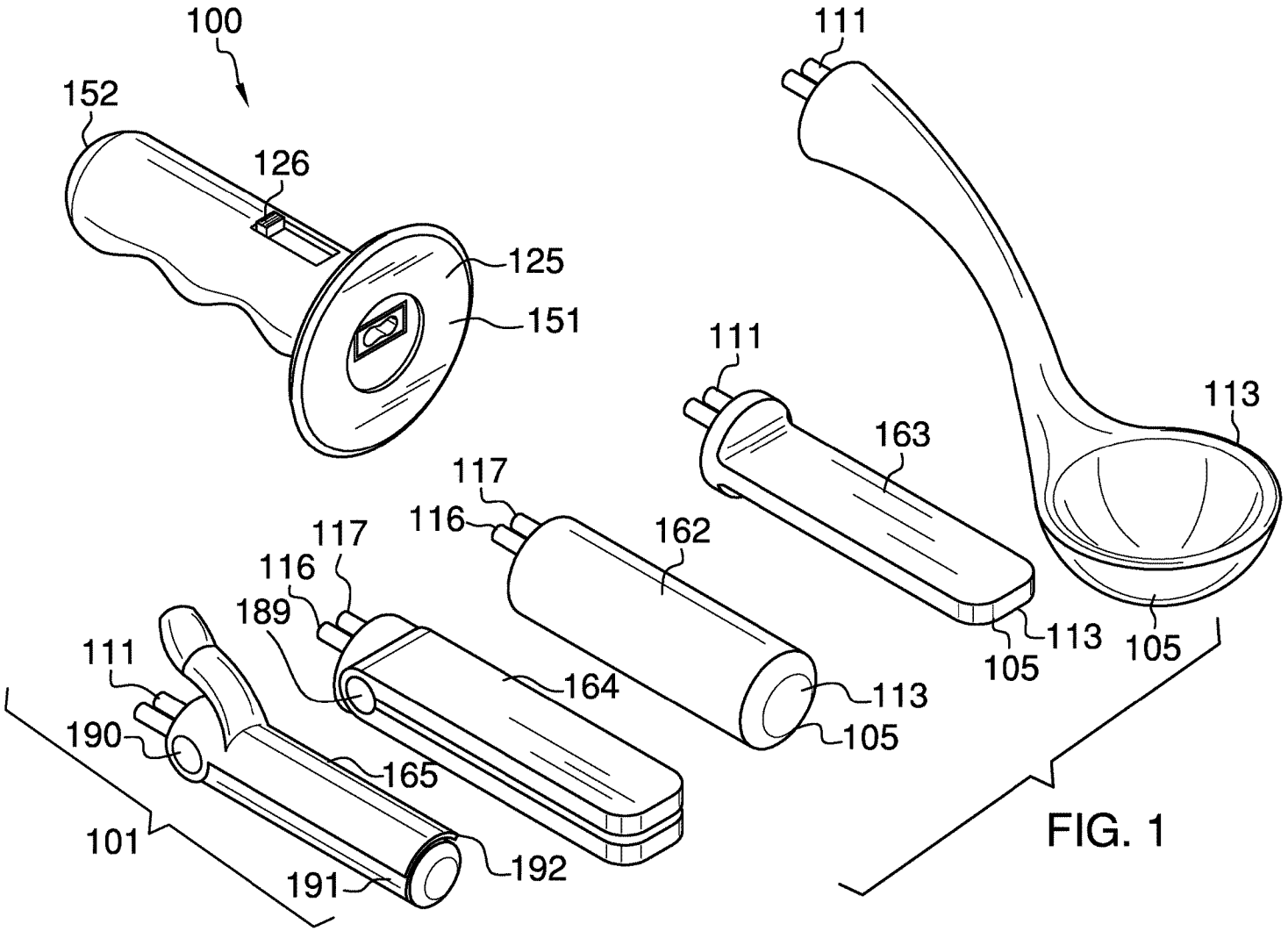
FIG. 1 is a perspective view of an embodiment of the disclosure.
Figure 2:
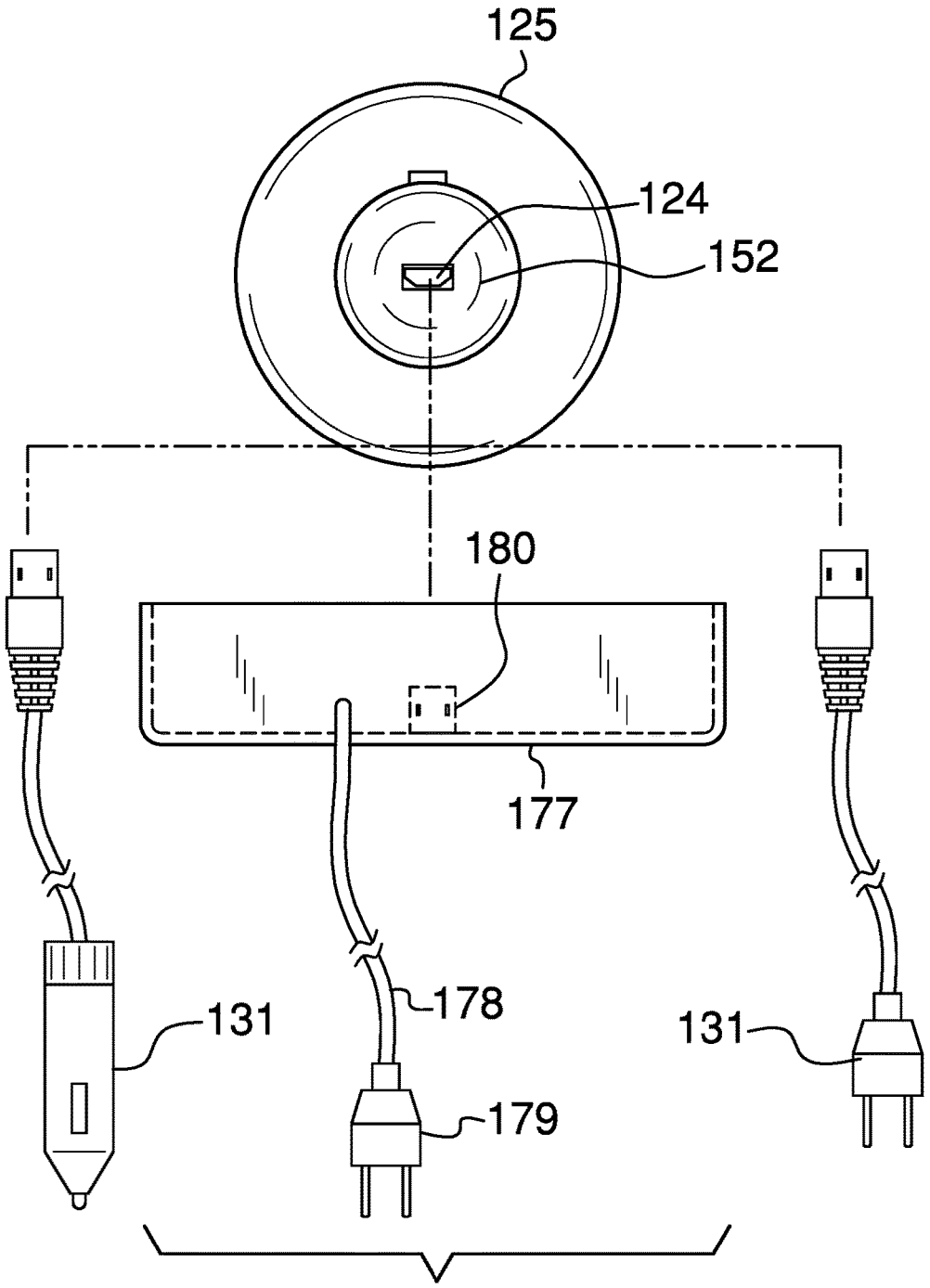
FIG. 2 is a back view of an embodiment of the disclosure.
Figure 3:
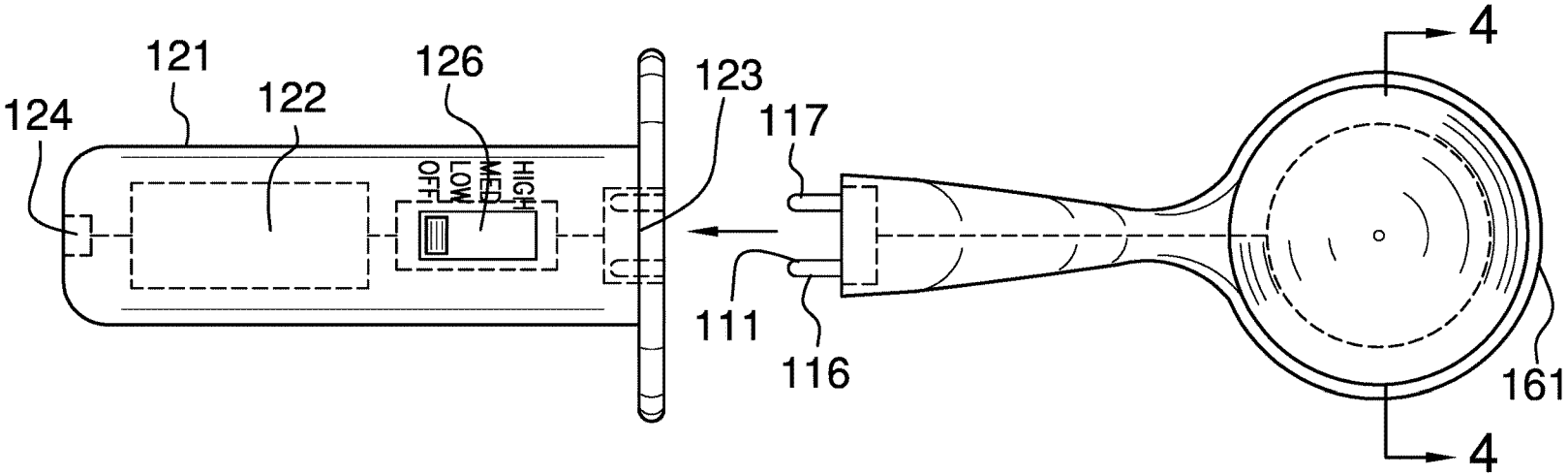
FIG. 3 is a top view of an embodiment of the disclosure.
Figure 4:
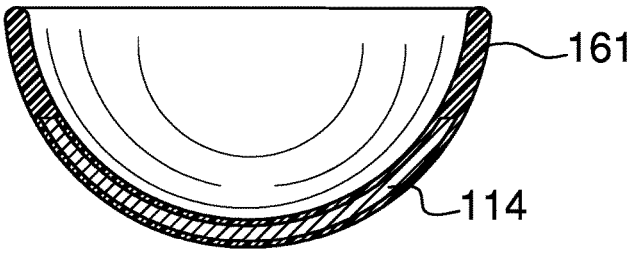
FIG. 4 is a cross-sectional view of an embodiment of the disclosure across line 4-4 in FIG. 3.
Figure 5:
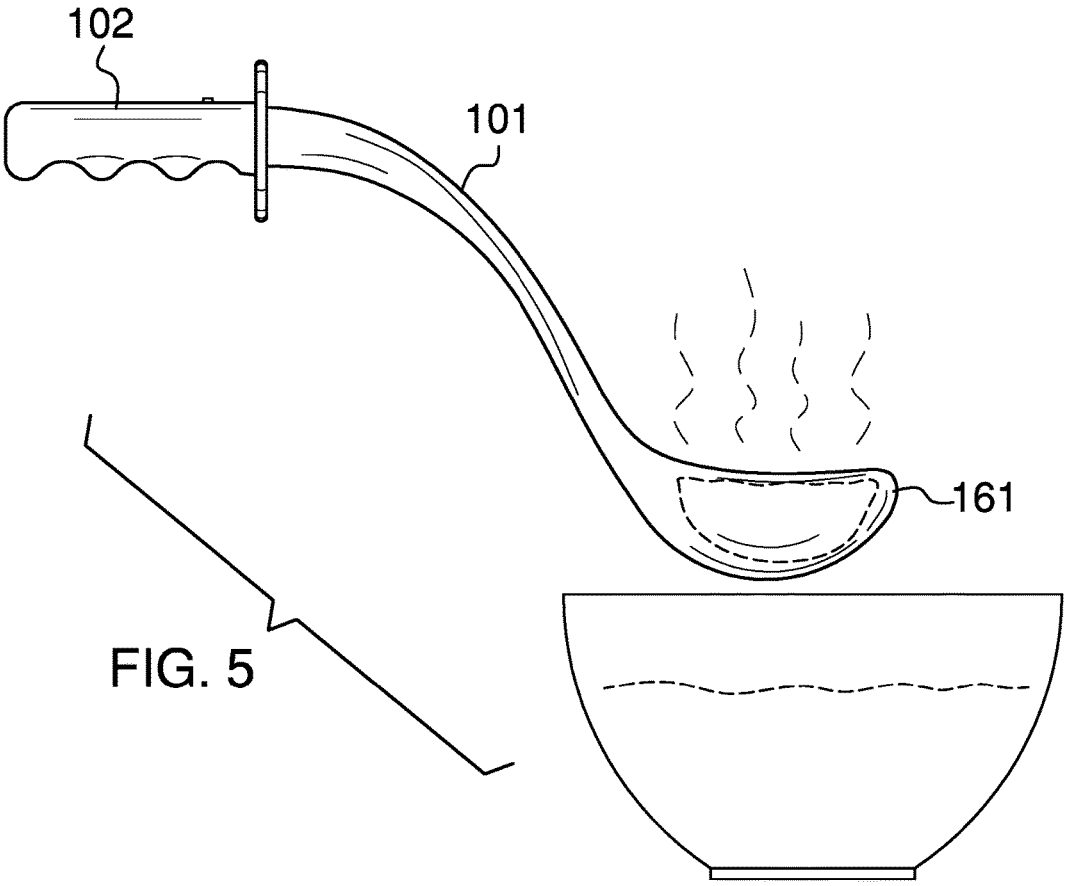
FIG. 5 is an in use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 6.

The portable food-warming device 100 (hereinafter invention) comprises a plurality of kitchen equipment items 101 and a handle 102. The invention 100 is designed such that each of the plurality of kitchen equipment items 101 can be attached to and detached from the handle 102. Each of the plurality of kitchen equipment items 101 further contains a heating element 114 that heats the food that the individual kitchen equipment item 105 is processing or serving. Alternatively, the plurality of kitchen equipment items 101 may be referred to as a plurality of equipment items 101, and may include accessories that work to heat up things aside of food. Moreover, the plurality of equipment items 101 may include tools that are adapted to be used in curling or straightening one's hair.

The handle 102 contains the power and controls necessary to heat the food that the individual kitchen equipment item 105 is processing or serving.

Each of the plurality of kitchen equipment items 101 further comprises a two-prong plug 111, a utensil 113, a heating element 114, and the associated wiring 115. Each of the plurality of kitchen equipment items 101 is formed from two pieces made from a conductive metal. When the two pieces of conductive metal are joined together a chamber is formed within which the heating element 114 and the associated wiring 115 is placed.

The heating element 114 is a commercially available heating element made from a material selected from the group consisting of ceramic or titanium. The associated wiring 115 is an insulated wire pair that connects the heating element 114 to the two-prong plug 111. The two-prong plug 111 further comprises a first conductive post 116 and a second conductive post 117. One wire selected from the wire pair that comprises the associated wiring 115 is connected to the first conductive post 116 and the remaining wire from the wire pair that comprises the associated wiring 115 is connected to the second conductive post 117. The two-prong plug 111 is positioned and sized to be received by a two-prong jack 123 which will provide power to the heating element 114. The two-prong plug 111 is discussed elsewhere in this disclosure.

When assembled, each of the plurality of kitchen equipment items 101 is a utensil 113 designed for kitchen use. In the first potential embodiment of the disclosure, the utensils 113 contained in the plurality of kitchen equipment items 101 comprises a serving spoon 161, a beverage cylinder 162, a heating plate 163, a flat hair iron 164, and a hair curler 165. The use of the utensils 113 contained in the plurality of kitchen equipment items 101 is discussed elsewhere in this disclosure.

The flat hair iron 164 and the hair curler 165 are well known in the art of hair styling and tools for use in styling hair, more generally. The flat hair iron 164 enjoys an iron hinge 189 that enables the flat hair iron 164 to open and close in order to receive and flatten hair. The hair curler 165 enjoys a spring-loaded curler hinge 190 that enables hair to be wrapped around a curler member 191. Moreover, the hair is secured via a clip 192 that is biased against the curler member 191 via the spring-loaded curler hinge 190.

The handle 102 further comprises a housing 121, a rechargeable battery 122, the two-prong jack 123, a USB port 124, a shield 125 and a single pole multi throw switch 126. The housing 111 is made from an insulating and heat resistant material. Suitable materials include, but are not limited to, polycarbonate or poly(methyl methacrylic). The housing 121 provides the structure within which and on the remaining components of the handle 102 are mounted. The housing 121, and by implication the handle 102, further comprises a first end 151 and a second end 152. The shield 125 is a disk that is located on the first end 151 of the handle 102 and is formed from the same material as the housing 121. The shield 125 protects the user from inadvertently touching a hot individual kitchen equipment item 105 that is plugged into the handle 102. The rechargeable battery 122, the two-prong jack 123, and the USB port 124 are mounted inside the handle 102. The rechargeable battery 122 is a commercially available rechargeable battery. Lithium ion batteries are preferred as the rechargeable battery 122.

Figure 6:
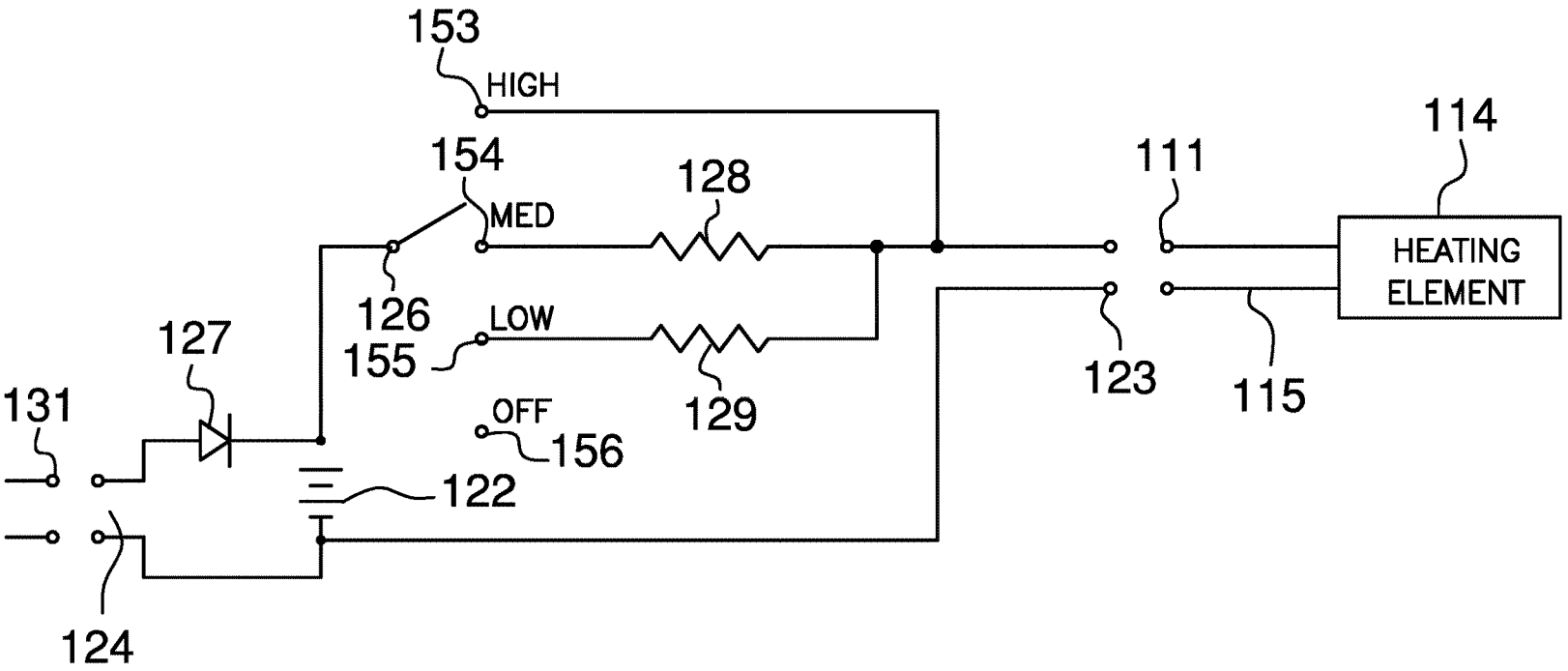
FIG. 6 is a schematic of an embodiment of the disclosure.

As shown in FIG. 6, the USB port 124 is wired across the rechargeable battery 122 such that the rechargeable battery 122 is optionally recharged via the USB port 124. The USB port 124 is located on the second end 152 of the handle 102. A diode 127 is placed in the circuit to prevent the rechargeable battery 122 from discharging through the USB port 124. The single pole multi throw switch 126 is used to control current flow through the heating element 114.

As shown in FIG. 6, the single pole multi throw switch 126 further comprise a first throw 153, a second throw 154, a third throw 155, and a fourth throw 156. The first throw 153 provides a direct connection to the heating element 114 and will generate the maximum heat. If the single pole multi throw switch 126 is set to the fourth throw 156, the fourth throw 156 is an open connection, which effectively turns off the heating element 114. The second throw 154 of the single pole multi throw switch 126 has a first resistor 128 placed in series between the rechargeable battery 122 and the heating element 114. This reduces the amount of heat generated by the heating element 114 relative to the first throw 153. The third throw 155 of the single pole multi throw switch 126 has a second resistor 129 placed in series between the rechargeable battery 122 and the heating element 114. The second resistor 129 has greater resistance than the first resistor 128 which further reduces the amount of heat generated by the heating element 114 relative to the second throw 154.

To use the invention 100, the invention 100 is first plugged into a USB charging device 131, which provides power to charge the rechargeable battery 122. A battery charger base 177 may be included with the invention 100. The battery charger base 177 includes a standard electrical cord 178 and plug 179 to be adaptively inserted into a standard electrical out 400. The battery charger base 177 includes a USB plug 180 that works in concert with the USB port 124 of the handle 102 to recharge the rechargeable battery 122.

Once the rechargeable battery 122 is at full power, an individual kitchen equipment item 105 selected from the plurality of kitchen equipment items 101 is selected and plugged into the handle 102. The individual kitchen equipment item 105 is then heated by turning the single pole multi throw switch 126 to a throw other than the open throw. In the first potential embodiment of the disclosure, the open throw is the fourth throw 156.

In the first potential embodiment of the disclosure: 1) if the serving spoon 161 is selected, any food or a beverage that is placed in the serving spoon 161 is kept in the serving spoon 161 until the food or beverage comes to the desired temperature; 2) if the beverage cylinder 162 is selected, the beverage cylinder 162 is placed in a glass or cup with a beverage until the beverage comes to the desired temperature; and, 3) if the heating plate 163 is selected food is placed on the heating plate 163 (much as if the heating plate 163 were a spatula) and is kept there until the food comes to the desired temperature.

In the first potential embodiment of the disclosure, each of the plurality of kitchen equipment items 101 is formed as two joined pieces of cast aluminum. The handle 102 is formed as two joined pieces of molded polycarbonate.

The following definitions were used in this disclosure:

Battery: As used in this disclosure, a battery is a container consisting of one or more cells, in which chemical energy is converted into electricity and used as a source of power.

Disk: As used in this disclosure, a disk is a cylindrically shaped object that is flat in appearance.

Handle: As used in this disclosure, a handle is an object by which a tool, object, or door is held or manipulated with the hand.

Housing: As used in this disclosure, a housing is a rigid casing that encloses and protects one or more devices.

USB: As used in this disclosure, USB is an acronym for Universal Serial Bus, which is an industry standard that defines the cables, the connectors, the communication protocols and the distribution of power required for interconnections between electronic devices. The USB standard defines several connectors including, but not limited to, USB-A, USB-B, mini-USB, and micro USB connectors. In this disclosure, the USB is used as a power distribution standard.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A utensil kit comprising:

a plurality of equipment items and a handle;

wherein the plurality of equipment items is a kit of individual tools that can be attached to and detached from the handle;

wherein each of the plurality of equipment items further contains a heating element;

wherein the heating element of each of the plurality of equipment items is adapted to heat food that an individual equipment item of the plurality of equipment items is processing or serving or is adapted to heat human hair for a hair-styling process;

wherein the handle contains a power and controls necessary to operate the heating element of each of the plurality of equipment items;

wherein each of the plurality of equipment items further comprises a two-prong plug, a utensil, and a wiring;

wherein each of the plurality of equipment items is formed from two pieces made from a conductive metal;

wherein the two-prong plug of each of the plurality of equipment items further comprises a first conductive post and a second conductive post;

wherein the two-prong plug of each of the plurality of equipment items is positioned and sized to be received by a two-prong jack which will provide power to the heating element of each of the plurality of equipment items;

wherein the plurality of equipment items comprises a serving spoon, a beverage cylinder, a heating plate, a flat hair iron, and a hair curler;

wherein the handle further comprises a housing, a rechargeable battery, the two-prong jack, a USB port, a shield and a single pole multi throw switch;

wherein the housing is made from an insulating and heat resistant material;

wherein the housing further comprises a first end and a second end;

wherein the shield is a disk that is located on the first end of the housing and is formed from the same material as the housing;

wherein the rechargeable battery, the two-prong jack, and the USB port are mounted inside the handle;

wherein the USB port is wired across the rechargeable battery such that the rechargeable battery can be recharged by the USB port;

wherein the USB port is located on a second end of the handle;

wherein a diode is placed in series between the USB port and the rechargeable battery;

wherein the single pole multi throw switch controls current flow through the heating element of each of the plurality of equipment items;

wherein the single pole multi throw switch further comprise a first throw and a second throw;

wherein the single pole multi throw switch further comprise a third throw;

wherein the third throw places a first resistor in series between the rechargeable battery and the heating element of each of the plurality of equipment items;

wherein the single pole multi throw switch further comprise a fourth throw;

wherein the fourth throw places a second resistor in series between the rechargeable battery and the heating element of each of the plurality of equipment items;

wherein the second resistor has a different resistance value than the first resistor;

wherein the flat hair iron includes an iron hinge that enables the flat hair iron to open and close in order to receive and flatten hair;

wherein the hair curler includes a spring-loaded curler hinge that enables hair to be wrapped around a curler member;

wherein the hair is secured via a clip that is biased against the curler member via the spring-loaded curler hinge;

wherein the first throw provides a direct connection to the heating element of each of the plurality of equipment items;

wherein the second throw is an open connection.

2. The utensil kit according to claim 1 wherein the heating element of each of the plurality of equipment items is made from a material selected from the group consisting of ceramic or titanium.

* * * * *